United States Patent [19]

Halbich

[11] 4,071,065

[45] Jan. 31, 1978

[54] ONE PIECE CONTAINER PARTICULARLY ADAPTED FOR CALCULATORS

[76] Inventor: Frank Halbich, 11983 Salem Drive, Granada Hills, Calif. 91344

[21] Appl. No.: 751,119

[22] Filed: Dec. 16, 1976

[51] Int. Cl.[2] ..... A45C 11/00

[52] U.S. Cl. ..... 150/52 R; 206/305; 206/591

[58] Field of Search ..... 150/52 R, 52 J; 229/44 CB; 220/62, 339; 206/591, 592, 305

[56] References Cited

U.S. PATENT DOCUMENTS

| | | | |
|---|---|---|---|
| D. 156,918 | 1/1950 | Rosenthal | 150/52 J UX |
| 2,000,337 | 5/1935 | Keuffel | 150/52 R |
| 3,327,888 | 6/1967 | Chalmers | 229/44 CB X |
| 3,338,390 | 8/1967 | Gordon | 206/591 X |
| 3,380,608 | 4/1968 | Morbeck | 220/62 X |
| 3,512,631 | 5/1970 | Price | 150/52 R X |
| 3,587,699 | 6/1971 | Kovach | 150/52 R |
| 3,595,433 | 7/1971 | Jones | 220/339 X |
| 3,900,550 | 8/1975 | Oliver | 220/339 X |
| 4,011,940 | 3/1977 | Neal | 220/339 X |

*Primary Examiner*—Donald F. Norton
*Attorney, Agent, or Firm*—Herzig & Walsh Incorporated

[57] ABSTRACT

A one-piece container formed as an injection molding preferably from polypropylene. The single piece is molded in preformed sections joined by thinner portions or parts of material which serve as hinges, the sections being relatively moveable about these parts. The sections are preformed to constitute portions of a container along with a closure for the container so that when the sections are moved about joint parts a complete container with a closure cover is formed. Preferably the container has inwardly extending flexible members formed on at least one section to engage an article within the container to retain it in position. The container is particularly adapted for use with calculators.

7 Claims, 9 Drawing Figures

Fig. 1
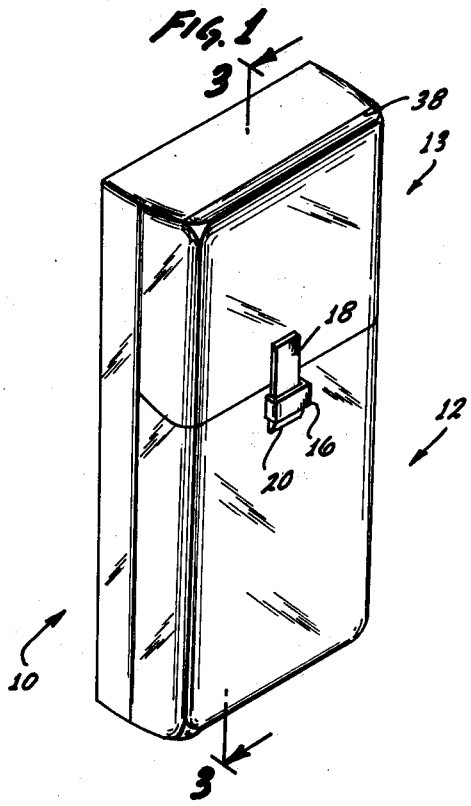
Fig. 2
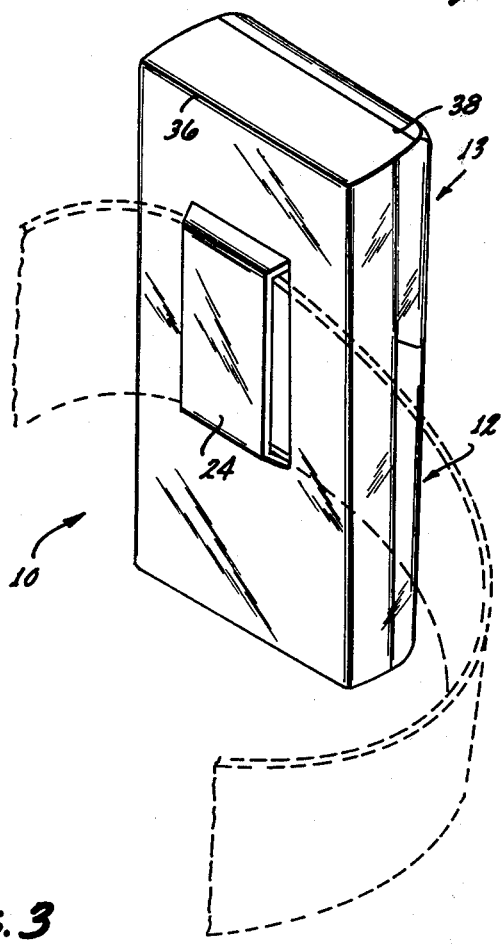
Fig. 3
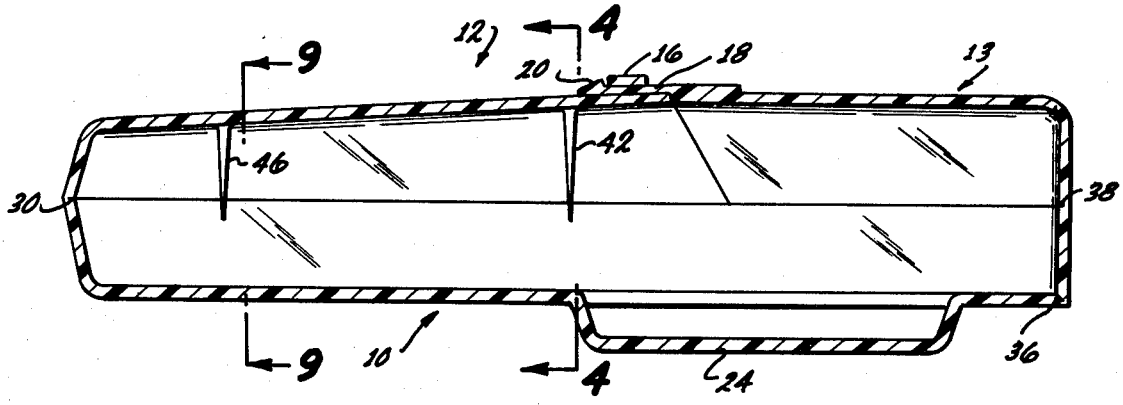
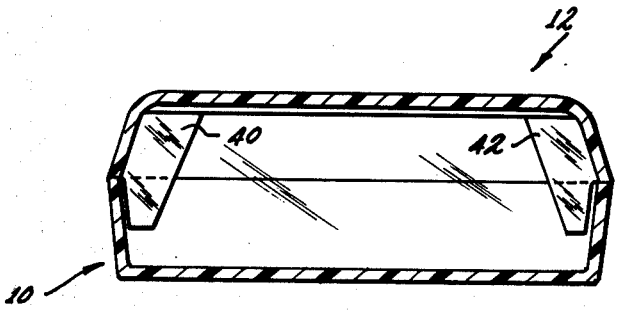
Fig. 4

ONE PIECE CONTAINER PARTICULARLY ADAPTED FOR CALCULATORS

BACKGROUND OF THE INVENTION

1. Field of the Invention

The field of the invention is that of containers or holders particularly of types made out of relatively thin materials.

2. Description of the Prior Art

Many types of containers such as boxes, etc. are known in the prior art, such articles being formed of materials such as cardboard, plastic, or otherwise. As far as known, the prior art does not include any article having the particular nature and unique construction of the container described in detail hereinafter.

SUMMARY OF THE INVENTION

As indicated in the abstract the article of the invention is a container of a type which is particularly adapted for holding and/or carrying calculators. Calculators are of somewhat delicate or fragile construction and need the protection of a carrying case or container when being transported and also to provide protection for the operating mechanisms of the calculator.

In the preferred exemplary embodiment of the invention as described in detail herein, it is constructed as a single piece or a single plastic injegtion molding, a preferred material being polypropylene. The single piece is molded in sections, in the preferred form of the invention there preferably being three preformed sections joined by the relatively thin hinge portions of material. Two of the preformed sections can be moved relatively, that is rotated towards each other about a hinge portion to form the major part of a container, the third section being preformed to provide a closure or cover that is rotatable around the hinge portion relative to the other sections.

The primary object of the invention is to originate and provide a container or case of relatively inexpensive and simplified construction which can be fabricated from a single plastic injection molding molded in preformed joined sections from which the finished container is formed.

A further object is to provide a container as in the foregoing wherein the single molding includes three preformed sections with material between them serving as hinges which can be folded relative to each other to form a completed container with a cover.

Further objects and additional advantages of the invention will become apparent from the following detailed description and annexed drawings.

BRIEF DESCRIPTION OF THE DRAWINGS

FIG. 1 is an isometric view of a preferred form of the article of the invention;

FIG. 2 is an isometric rear view of the article of FIG. 1 showing a loop on the back adapted to be received on a belt;

FIG. 3 is a sectional view taken along the line 3—3 of FIG. 1;

FIG. 4 is a sectional view taken along the line 4—4 of FIG. 3;

DESCRIPTION OF THE PREFERRED EMBODIMENT

Figure 5:
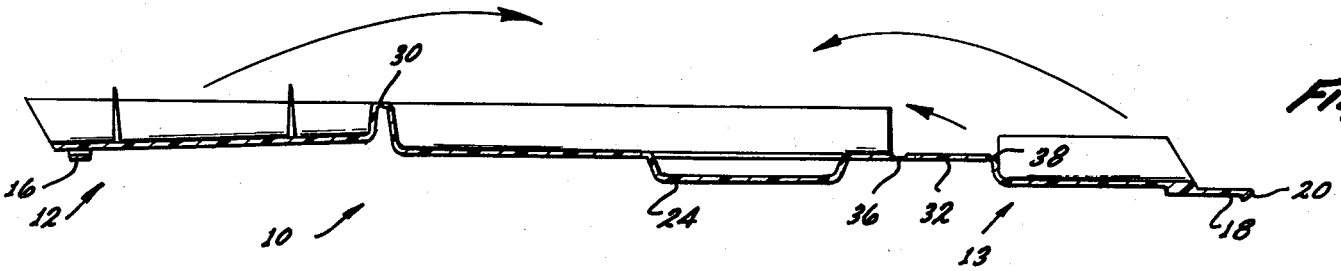
FIG. 5 is a sectional view of the single injection molding from which the article is formed.

FIGS. 1 and 2 illustrate a preferred form of the article of the invention in the form of a generally rectilinear container of a size adapted for holding small or miniature calculators. As will presently be described, the article is formed from a single plastic injection molding. In the preferred form the molding is fabricated in three sections. Numeral 10 designates one section which is a base section providing a back wall, sides and ends of the container. Numeral 12 designates a second section which is connected to the section 10 by hinge part as will be described. The section 12 has a front wall, side walls, and on end wall and when juxtaposed against the section 10 as shown forms a portion of the complete container. Numeral 13 designates the third section which is joined to the section 10 by a hinge portion as will be described. The section 13 has a front wall portion, side wall portions, and an end wall as shown and when folded into closed position as shown in FIGS. 1 and 2 a complete enclosing container is provided, the section 13 forming the closure or cover.

On the section 12 is an extending loop 16 and on the section 13 is an extending tab 18 which can slip through the loop 16 the tab having tapered end part 20 which has a square shoulder that engages against the loop 16 in closed position holding the part secured.

On the back wall of the section 10 there is an outwardly displaced portion 24 forming a loop through which a belt can be passed for securing the container on one's belt as shown.

As indicated the device is formed from a single piece of material which is preferably an injection molding of material preferably polypropylene. FIG. 5 shows in cross section the single preformed molding. The material may be in the range of 0.0080 inches in thickness, except at the areas where the sections are joined, the material at these parts being thinner, being in the range of 0.005 to 0.010 inches in thickness. The parts or portions between sections are designated in FIG. 5 at 30 and 32. These portions form the hinges.

Figure 6:
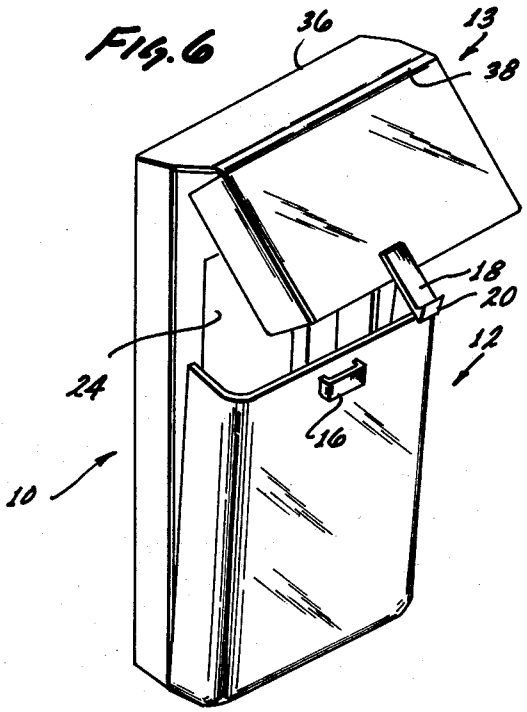
FIG. 6 is an isometric view of the article of FIGS. 1 and 2 showing the cover open.

To form the article, in the position of FIG. 5, the sections 12 and 13 can be rotated around the hinges in the direction as indicated by the arrows. Section 12 comes into a position with respect to the section 13 as illustrated in FIGS. 3 and 6. The edges of the side walls of the section 10 and the edges of the side walls of the section 12 that come together as may be seen in FIG. 6 can be adhesively bonded together if desired.

With respect to the portion of material 32 between sections 10 and 13, preferably it provides two thinner hinge parts as designated at 36 and 38. When the cover section 38 is folded as illustrated in FIG. 5 it goes into a position as illustrated in FIGS. 3 and 6. As may be seen the cover section 13 and portion 32 form an end wall for the container. The edges of the end walls of the cover section 13 come into juxtaposition against edges of the side walls of the section 10 when the cover is closed. The end walls of the cover 13 have a bevel as shown that is complementary to a similar bevel at the ends of the side walls of the section 12 as may be seen in FIGS. 5 and 6.

Figure 9:
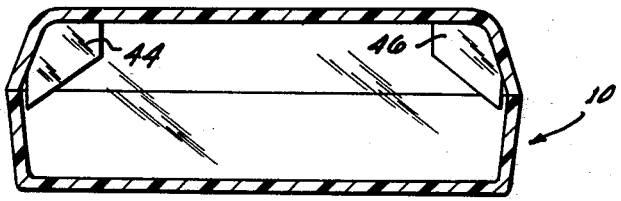
FIG. 9 is a sectional view taken along the line 9—9 of FIG. 3.

On the inside of the section 12 extending downwardly are relatively thin flexible ribs as may be seen at 40 and 42 in FIG. 4 and additional similar flexible webs 44 and 46 of different configuration as may be seen in FIG. 9. The purpose of these webs is that they come into engagement with an article such as a calculator when it is placed into a container to retain it in position without jouncing around.

Figure 7:
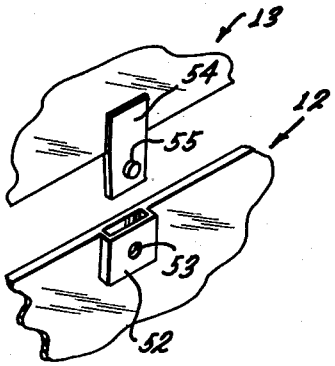
FIG. 7 is a detail isometric view of a modified form of fastening tab for the cover.

FIG. 7 shows a slightly modified form of holding tab which includes a rectilinear receptacle 52 on the section 12 with a hole 53 in it. The tab 54 can fit into the receptacle 52 and extending projection 55 is configurated to fit through the hole 53 and hold the parts secured together.

Figure 8:
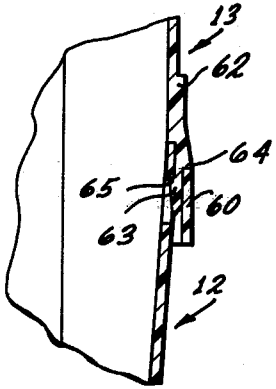
FIG. 8 is a detail isometric view of another modified form of holding tab.

FIG. 8 shows another modified form of holding means. In this form there is provided on the outside of the section 12 a loop of material as designated at 60. On the section 30 is a tab 62 having tongue 63 which can extend down into the loop 60, the tab 62 having a square shoulder 64 on the outside which fits against the top of the loop 60, tab 62 having a square shoulder on the inside thereof which fits against the edge of an opening 66 in the surface of the outside wall of the section 12.

From the foregoing those skilled in the art will readily understand the nature of the invention and the manner in which it achieves and realizes all of the objectives as set forth in the foregoing.

The foregoing disclosure is representative of preferred forms of the invention and is to be interpreted in an illustrative rather than a limiting sense, the invention to be accorded the full scope of the claims appended hereto.

What is claimed is:

1. An article which is a container which is formed from substantially a single piece of material which includes a piece of material formed in sections, the sections being joined by hinge parts of the material which is sufficiently thin to allow hinging movement of the material, whereby sections adjacent to a hinge part can be moved relatively with respect to the hinge part, certain of said sections being preformed to constitute portions of a container and to form a container when the sections are moved relatively with respect to a joining hinge part, and a further section being preformed to constitute a closure and moveable relative to a hinge part to provide a closure for a container formed by other sections, there being three sections, which lie in a plane before movement about the hinge parts, said sections including a back section having at least partial side walls and at least a partial bottom wall portion, a front section having at least partial side walls and at least a partial bottom wall portion, said front and back sections being constructed to be moved relatively about a hinge part so that the said partial side walls and partial bottom walls on the front and back sections come into juxtaposed abutting relationship, and a third section forming a cover section attached to the back section by a hinge part, the cover section having a front portion and at least partial side walls constructed to come into juxtaposed abutting relation with partial side walls on the back section with the cover section forming a closure for a portion of the front of the container.

2. An article as in claim 1, wherein the material is a relatively thin plastic material, the hinge parts being of thinner material than the sections themselves.

3. An article as in claim 2, wherein the material is polypropylene.

4. An article as in claim 1, wherein the single piece of material is an injection molding.

5. An article as in claim 1, wherein at least one of the sections has extending flexible webs positioned so as to engage an article within the container to retain it in position.

6. An article as in claim 1 wherein said front section is constructed to form only a portion of the front of the container, said cover section being constructed to provide the remaining portion of the front of the container, the front section and the cover section having end portions constructed to some into juxtaposed abutting relationship when the cover is closed.

7. A container as in claim 1 wherein the partial side walls on the three sections and the partial bottom walls on the front and back sections are of such an extent that the partial walls come into abutting relationship along a line substantially midway of the depth of the container.

* * * * *